US007527002B2

(12) United States Patent
Riser

(10) Patent No.: US 7,527,002 B2
(45) Date of Patent: May 5, 2009

(54) CABLEWAY CABIN

(75) Inventor: Georg Riser, Böckten (CH)

(73) Assignee: CWA Constructions S.A., Olten (CH)

( * ) Notice: Subject to any disclaimer, the term of this patent is extended or adjusted under 35 U.S.C. 154(b) by 416 days.

(21) Appl. No.: 11/158,711

(22) Filed: Jun. 22, 2005

(65) Prior Publication Data

US 2006/0005476 A1 Jan. 12, 2006

(30) Foreign Application Priority Data

Jul. 7, 2004 (CH) ..... 1137/04

(51) Int. Cl.
*B61B 3/00* (2006.01)

(52) U.S. Cl. ..... 105/148; 105/406.1; 403/217; 403/362; 52/79.9

(58) Field of Classification Search ..... 248/49, 248/97; 174/68.1, 68.3, 72 R, 97, 101, 157; 403/217, 362, 169–175; 135/120.3, 131, 135/143–145; 52/79.9, 645, 646, 648.1; 105/148, 406.1
See application file for complete search history.

(56) References Cited

U.S. PATENT DOCUMENTS 3,100,555 A * 8/1963 Ashton ..... 52/651.01
3,881,830 A * 5/1975 Kato et al. ..... 403/171
4,299,508 A * 11/1981 Kerscher et al. ..... 403/172
4,705,286 A * 11/1987 Lauzier et al. ..... 280/281.1
5,421,666 A * 6/1995 Spears ..... 403/176
2004/0245513 A1* 12/2004 Izumi ..... 256/65.02

FOREIGN PATENT DOCUMENTS

CH 626842 12/1981
DE 3447036 7/1986

* cited by examiner

*Primary Examiner*—Korie H. Chan
(74) *Attorney, Agent, or Firm*—Oblon, Spivak, McClelland, Maier & Neustadt, P.C.

(57) ABSTRACT

A cableway cabin, having supporting elements including a base frame, a roof frame and at least four corner columns connecting the base frame to the roof frame. All these parts are formed only from tubular sections having a circular inner cross-section. The parts are which has three connecting pieces, at least one of which is conical and one of which in each case is pressed into one of the three tubular sections forming a corner. Unless all three connecting pieces are conical, it is expedient to make the non-conical connecting piece or connecting pieces cylindrical and to provide them with a constriction extending over more than 60% of their length and filled with a resilient adhesive.

5 Claims, 1 Drawing Sheet

CABLEWAY CABIN

BACKGROUND OF THE INVENTION

The invention relates to a cableway cabin for suspended or continuous cableways, the supporting elements of which consist of a base frame, a roof frame and at least four corner columns connecting the base frame to the roof frame. In such cabins, as disclosed, for example, in CH 626 842, the frame parts, which today usually consist of a light metal alloy, are produced from profile rods having a more or less freely selectable cross-sectional shape and are screwed or riveted or welded at the corners either to one another or to a corner connecting point. This is not optimum both from constructional points of view and with regard to the production process.

SUMMARY OF THE INVENTION

It is therefore the object of the invention to provide a construction which, compared with known corners connections, has advantages which therefore permit rapid and economical connection of the individual profiled sections forming the cabin frame. DE 34 47 036 A discloses temporary fixing, e.g. fixing until final fastening, between a profile rod and a node element. In this known construction, one component has, at least in sections, projections which, when the connection is assembled, act on the opposite surface of the other component under initial stress, with the result that the two parts are temporarily fixed without additional means until final fastening.

The present invention relates not to a temporary connection but to a permanent connection between the corner connecting parts and the frame parts, none of which has projections. In the case of a cableway cabin according to the invention, this connection is characterized by the features of the characterizing clause of claim 1. The other claims indicate optional embodiments of the invention.

A preferred embodiment of the invention is described below with reference to the attached drawing.

BRIEF DESCRIPTION OF THE DRAWING FIGURES

DETAILED DESCRIPTION OF THE PREFERRED EMBODIMENTS

Figure 1:
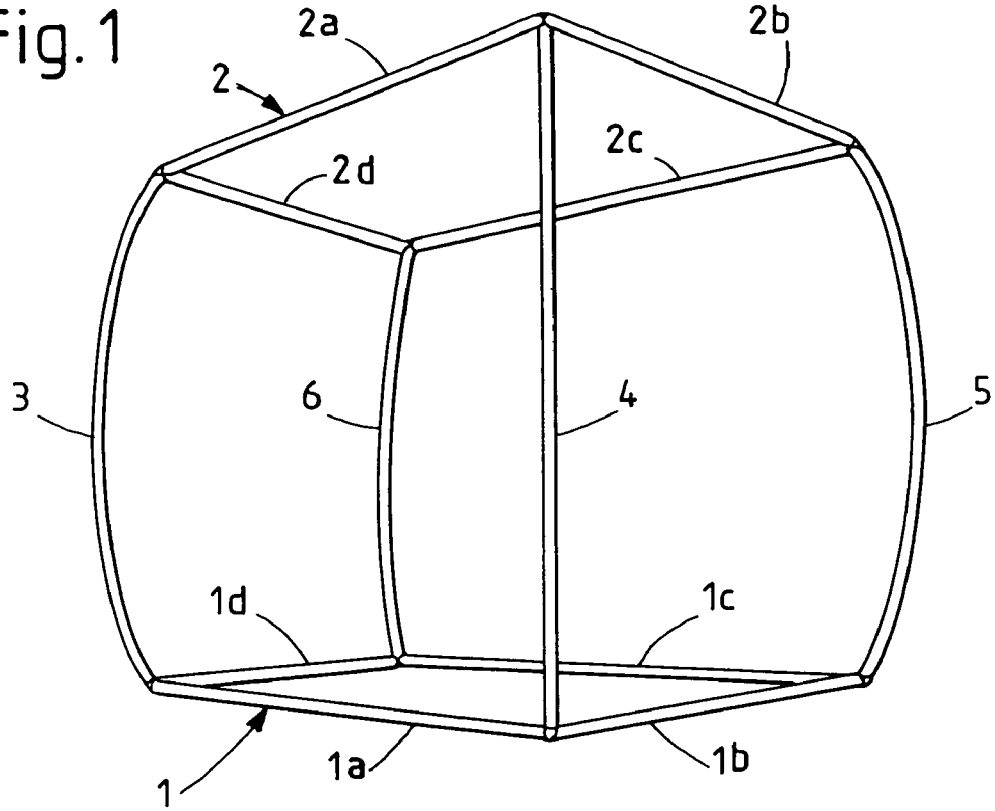
FIG. 1 shows a frame of a cableway cabin.

As is evident from FIG. 1, the supporting elements of the cabin consist of a tetragonal base frame 1 formed from four tubular sections 1*a*, 1*b*, 1*c* and 1*d*, a likewise tetragonal roof frame 2 formed from four tubular sections 2*a*, 2*b*, 2*c* and 2*d* and at least four corner columns 3, 4, 5 and 6 connecting the base frame 1 to the roof frame. All these tubular sections have a circular inner cross-section while they may have any desired outer shape, so that the base and the walls and the roof construction can be fastened to them in a simple manner. In the embodiment shown, the tubular sections forming the two frames 1 and 2 are straight but the corner columns 3, 4, 5 and 6 are curved. However, it is readily possible to use only straight or curved tubular sections.

Figure 2:
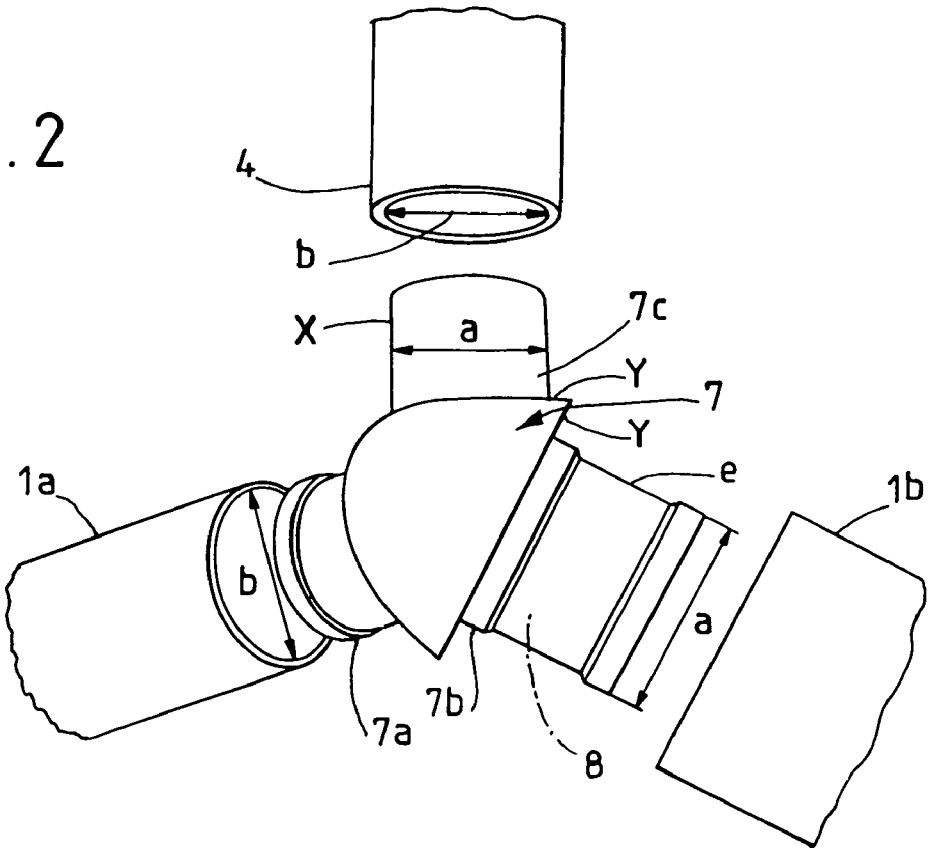
FIG. 2 shows a corner connection of such a frame.

FIG. 2 shows how three tubular sections 4, 1*a* and 1*b* forming a corner are connected to one another. A corner connecting part 7 which has three connecting pieces 7*a*, 7*b* and 7*c*, of which the two connecting pieces 7*a* and 7*b* here are cylindrical while the connecting piece 7*c* is slightly frusto-conical, serves for this purpose. Of course, it is not necessary for the connecting pieces to consist of solid material; depending on requirements, they may have a larger or smaller cylindrical cavity open towards the connecting piece end. The diameter a of the connecting piece 7*a* at the free connecting piece end is smaller than the internal diameter b of the tubular section having a circular inner cross-section, i.e. of section 4 here, into which it is pressed, the tubular section having 4 having, before being pressed in, a constant inner cross-section which corresponds approximately to the external diameter of the connecting piece at the point X which is away from the free connecting piece at the point X which is away from the free connecting piece end by 10% to 20% of the connecting piece length. At the free end of the connecting piece, its diameter is 0.1% -5% smaller that at the point Y at which the tube ends when it is pressed onto the connecting piece.

The angle between the axes of the three connecting pieces 7*a*, 7*b* and 7*c* does of course correspond to the respective angle which two tubular sections to be connected to one another have to make with one another. For connecting the corner column to the corner connecting part 7, the column is pushed, with the force required for expanding its end, onto the frusto-conical connecting piece 7*c* corresponding to it. Since only a sufficiently powerful press is required for this purpose, the tubular connection is on the one hand simple to produce and, on the other hand extremely strong, so that it is usually possible to dispense with the use of additional aids, such as, for example, adhesive or screws.

The other two connecting pieces 7*a* and 7*b* can also be designed in the same way as the connecting piece 7*c*. However, it is also possible to give them a cylindrical shape, the external diameter of which is only insignificantly smaller than the internal diameter b of the frame parts into which they are inserted. In this case, they can be provided with a constriction e which extends over at least 60% of the connecting piece length and is filled with a resilient adhesive 8. Suitable adhesive is preferably a one- or two-component adhesive which remains resilient even after hardening. For introduction of this adhesive after assembly of the frame-forming tubular sections, the tubular section can have, preferably on the inside of the cabin, an opening which can be closed with a screw. However, it is also possible to design a screw introduced through the tubular section into the connecting piece as a spray nozzle for the plastic adhesive.

A cableway cabin, the supporting elements of which are formed by tubular sections connected to one another in this simple manner, not only has the advantage of a relatively low weight but also the at least equally great advantage that neither for the designer nor for the constructor are there any constructional obstacles relating to the choice of the method of installation of the other components, such as walls, doors, benches, supports for skis and other sports equipment.

The invention claimed is:

1. The cableway cabin, comprising:

a base frame including at least four tubular supports;

a roof frame, parallel to the base frame, including at least four tubular supports;

at least four tubular corner columns; and connecting pieces connect the tubular supports of the base frame and the tubular supports of the roof frame to the tubular corner columns, each of the connecting pieces configured to receive two of the tubular supports and one corner column and being disposed at corners of the base frame and the roof frame of the cableway cabin, wherein:

each of the connecting pieces comprising:

a main body;

a first member extending outwardly from the main body having a proximal end connected to the main body and a free distal end opposite said proximal end, the first member defines a frusto-conical shape extending from the proximal end to the free distal end of the first member;

and a plurality of second members extending outwardly from the main body, each second member having a proximal end connected to the main body and a free distal end opposite said proximal end of the second member, each of the second members defines a cylindrical shape extending from the proximal end to the free distal end of the second member, wherein:

the first member of each of the connecting pieces connects with the tubular corner columns, and the plurality of second members of each of the connecting pieces connects with the tubular supports.

2. The cableway cabin according to claim 1, wherein the external diameter of the portion of each connecting piece which is frustro-conical at a point which is away from a free end by 10% to 20% of a length of the connecting piece corresponds to a pre-pressed internal diameter of the tubular section of the tubular corner columns into which the frustro-conical connecting piece is pressed.

3. The cableway cabin according to claim 1, wherein the diameter of the portion of each connecting piece which is frustro-conical at a free end is 0.1% to 5% smaller than at a point at which the tubular section, into which the frustro-conical connecting piece is pressed, ends.

4. The cableway cabin according to claim 1, wherein the portion of each connecting piece which has a cylindrical shape is provided with a constriction extending over more than 60% of the length of the cylindrical shape.

5. The cableway cabin according to claim 1, wherein at least one of the connecting pieces has a cylindrical cavity open towards an end of the connecting piece.

* * * * *